United States Patent [19]

Pichler et al.

[11] Patent Number: 4,578,835

[45] Date of Patent: Apr. 1, 1986

[54] TOOL OR SET OF TOOLS

[75] Inventors: Josef Pichler, Wagrain; Peter Kohlbrat, Radstadt; Raimund Falkner, Roppen; Karoly Tömpe, Hallein, all of Austria

[73] Assignee: Maschinenvertrieb Kohlbrat & Bunz Gesellschaft m.b.H., Austria

[21] Appl. No.: 514,814

[22] PCT Filed: Sep. 27, 1982

[86] PCT No.: PCT/AT82/00028

§ 371 Date: Jun. 16, 1983

§ 102(e) Date: Jun. 16, 1983

[87] PCT Pub. No.: WO83/01406

PCT Pub. Date: Apr. 28, 1983

[30] Foreign Application Priority Data

Oct. 20, 1981 [AT] Austria ..... 4475/81

[51] Int. Cl.[4] ..... B25G 1/00

[52] U.S. Cl. ..... 7/168; 7/167

[58] Field of Search ..... 29/331 R, 56.5; 123/179 SE; 408/241 R; 7/167, 168, 165, 170; 279/1 R, 1 K; 200/61, 58, 52 R, 85 R; 16/111 A; 70/456 R

[56] References Cited

U.S. PATENT DOCUMENTS

| | | | |
|---|---|---|---|
| 1,138,456 | 4/1915 | Curran | 7/165 X |
| 1,530,688 | 3/1925 | Murray | 7/165 X |
| 1,932,011 | 10/1933 | Beegle | 7/167 |
| 2,578,317 | 12/1951 | Pealer | 200/85 R |
| 2,630,212 | 3/1953 | Mosch | 70/456 R |
| 2,666,104 | 1/1954 | Griffin | 200/61.58 R |
| 2,706,902 | 4/1955 | Nichols | 70/456 R |
| 2,735,908 | 2/1956 | Peretil et al. | 200/52 R X |
| 2,736,354 | 2/1956 | Koskela | 7/168 X |
| 2,982,454 | 5/1961 | Wolberg | 7/168 X |
| 3,177,910 | 4/1965 | Da Silva | 7/165 X |
| 3,947,924 | 4/1976 | Fox | 408/241 R |
| 4,078,272 | 3/1978 | Mahon, III | 7/168 X |
| 4,100,637 | 7/1978 | Grieser et al. | 7/167 X |
| 4,175,298 | 11/1979 | Muller et al. | 7/138 |

FOREIGN PATENT DOCUMENTS

| | | | |
|---|---|---|---|
| 553325 | 5/1943 | United Kingdom | 279/1 K |
| 1432409 | 4/1976 | United Kingdom | 279/1 K |
| 1506550 | 4/1978 | United Kingdom | 7/167 |

*Primary Examiner*—William R. Briggs

*Attorney, Agent, or Firm*—Pahl, Lorusso & Loud

[57] ABSTRACT

An operating part, essential to the starting-up or use of a power-operated device (1), e.g. driven by an engine or a pressure-medium, is made in the form of a tool-carrier (4). Permanently attached to the tool-carrier (4) is at least one tool, preferably a set of tools, specifically intended for the maintenance, cleaning, or the like of the device. However, the operating part constituting the tool-carrier (4) is arranged detachably upon a functional element (2,3) of the device (1). It is therefore scarcely possible for the tool to be lost after it has been used, since the device (1) only becomes serviceable again (i.e. may be driven or guided by the operator) after the operating part of the device (1) which has been removed, and which constitutes the tool-carrier (4), has been replaced.

7 Claims, 8 Drawing Figures

TOOL OR SET OF TOOLS

The invention relates to a tool or set of tools, arranged upon a tool-carrier, for use with power-operated devices.

In this connection, the expression power-operated device is intended to encompass any device driven by power, for example by an engine or a pressure-medium. In devices of this kind, sundry tools are required for maintenance, cleaning conversion and fitting of accessory units. However, it is always a difficult problem to keep the tool (a screwdriver, wrench, spark-plug wrench etc. in the case of fuel-driven devices) handy, so that, on the one hand, it does not go astray and, on the other hand, it is within easy reach and does not interfere with the operation of the unit or with the operator. For instance, the accommodation of one or more tools is a closable container on the device, which is common in a very wide variety of vehicles, involves a risk of losing the tools, since they may not be returned to the container, the container may not be closed, etc. Tools may also be lost if carried by the operator and this has other disadvantages, in that the weight and the amount of room they take up may be troublesome and may also lead to injury.

Also known are pocket-knives comprising a whole series of folding out tools such as corkscrews, screwdrivers, bottle-openers etc., but such tools are intended for general use, not for special appliances. Apart from this, a loose pocket-knife can always be lost since, after it has been used as a tool, it need not be used any further. Similar criteria apply to other multi-purpose tools, such as handles with interchangeable tool-inserts etc.

Now it is the purpose of the invention to provide a tool or set of tools intended for use on power-operated appliances, whereby the danger of loss is practically eliminated.

According to the invention this problem is solved in that the tool carrier is formed by an operating part essential to the starting-up or use of the power-operated device, said operating part being arranged detachably upon a functional element of the said device. As used herein, the term 'working function' shall refer to a function absolutely essential to the starting up or use of the particular power operated device and, which further must be provided for such a power operated device, in general, to operate, e.g. delivering electric current to an electric motor.

According to the concept of the invention, therefore, the tools are inseparably associated with an essential, removable operating part of the device. Loss of the tool or tools is practically impossible, since in the event that a repair is carried out while the device is in use or in operation, such use or operation can be continued only after the operating part has been incorporated into the power-operated device again. In this connection, the tool or tools are designed in such a manner as not to interfere with the basic configuration of the operating part and not to alter the method of operation.

The operating part serving as the tool-carrier depends upon the type of power-operated device. In the case of devices operated entirely by muscle-power, the operating part will be a handle or a pedal. Examples of simple implements requiring a tool for continuous use are simple cutting or sawing tools such as scythes, sickles, felling saws, hand-saws, or the like requiring repeated sharpening of the cutting edges or teeth. Thus the, or a, handle, without which the implement cannot be used, may, according to the invention, be made detachable and may be designed as a tool-carrier for a whetstone or one or more files, etc.

In the case of engine-driven devices, the tool-carrier may be a manually actuated part of the starter. For fuel-driven devices such as chain-saws, lawn-mowers, small boats with outboard-engines, which frequently have starter-cables, the operating part acting as the tool-carrier may be the starter-handle fitted to the free end of the starter-cable. Othe fuel-operated devices may have the tool-carrier built into the kick-starter lever, for example. In the case of electrically driven, or electrically started, devices, the switch handle of the electric motor may be used. It is also conceivable to use the operating lever of a device operated by a pressure-medium as the tool-carrier.

In addition to these latter examples of tool-carriers in the form of operating parts for starting power-operated devices, the operating parts may also be essential to the use of the device. This applies not only to the above-mentioned handles of simple implements, but also to operating parts essential to the use of the device. In the case of engine-driven devices, these are usually in the form of carrying, holding or guiding handles, pedals, etc. In the case of portable devices having a carrying handle or the like, for example chain-saws, the tool-carrier may be a part of the carrying handle.

Obviously in devices having more than one essential operating part (for example a starter-handle and a holding grip), each part may constitute a tool-carrier, thus making available a wider variety of tools. It is also conceivable to incorporate the tool-carrier into guards or covers for the device, without which it cannot be used.

Another interesting aspect is for the operating part of the device, acting as a tool-carrier, to be in the form of a means for preventing unauthorized operation. In certain cases, devices are left on the site overnight after work has ceased, for example it is customary to leave chain-saws around during forestry operations. If the starter-handle is removed at the end of the day, the saw cannot be used until it has been refitted. The same applies to boats which may remain tied up for several hours without supervision.

According to the invention, one preferred example of such a tool-carrier comprises at least one holding part of approximately U-shaped cross-section, a pivot-axis mounted in the two lateral webs being arranged at least at one end of the holding part, and at least one tool being mounted to fold inwardly about the pivot-axis. In this design, as in the case of pocket-knives, a plurality of tools, i.e. a set of tools, specifically intended for the device, may be accommodated in the U-shaped holding part. Twice the number of tools may be accommodated if the tool-carrier comprises two holding parts of approximately U-shaped cross-section, whose bottoms are formed by a common central web.

The tools accommodated in the tool-carrier are basic tools, for example several sizes of simple screwdrivers, Philips screwdrivers, socket-head capscrew wrenches (Allen wrenches) and tools specifically designed for the device. Examples of these are: for fuel-driven devices, a spark-plug gap gauge, a wire brush; for chain-saws, a file for sharpening the teeth etc.; for electrically-driven devices, cutting pliers, and insulation-stripper, etc. Finally, in one preferred design at least one end-section of the tool-carrier is in the form of a socket wrench.

To facilitate folding out of the tools, which may be locked when in inoperative position, it has been found advantageous to mount a double-armed lever upon the pivot-axis, the arm projecting into the holding part bearing upon each tool, while the arm projecting out of the holding part serves as a pivot-lever to release the inwardly folded tools. The inner lever-arm forces the tools far enough out of the U-shaped holding part to enable them to be grasped conveniently, after which any tools not required may be folded back in again.

The joint between each attachment-section of the tool-carrier, as the operating part, and the associated part of the functional element of the power-operated device, is preferably in the form of a bayonet-fastener which may, if necessary, be acted upon by a resilient element, in order to prevent inadvertent rotation.

It is also conceivable to use pins locked with cotter-pins or spring-loaded slides engaging with the relevant part of the functional element. The type of joint is also adapted to the requirements of the power-operated device.

The operating part acting as a tool-carrier may be made by any suitable material. For example, parts of any desired shape and low weight may be produced in the form of injection-mouldings of particularly fibre-reinforced, high-strength thermoplastic materials, for instance glass or carbon-reinforced polyamides.

The invention is explained hereinafter, in greater detail, in conjunction with the embodiments illustrated in the drawings attached hereto, but it is not restricted thereto.

Figure 1:
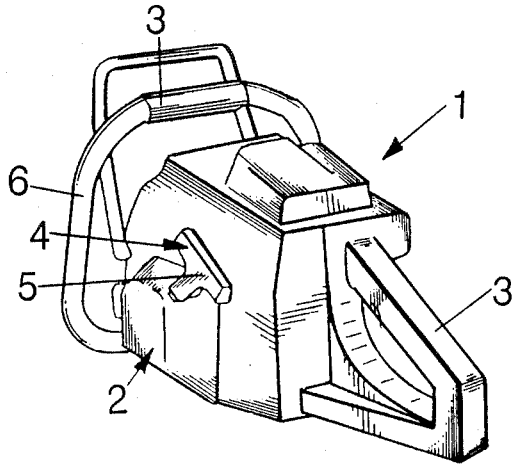
FIG. 1 is a diagrammatical perspective of a chain-saw as an example of a fuel-driven device.
Figure 2:
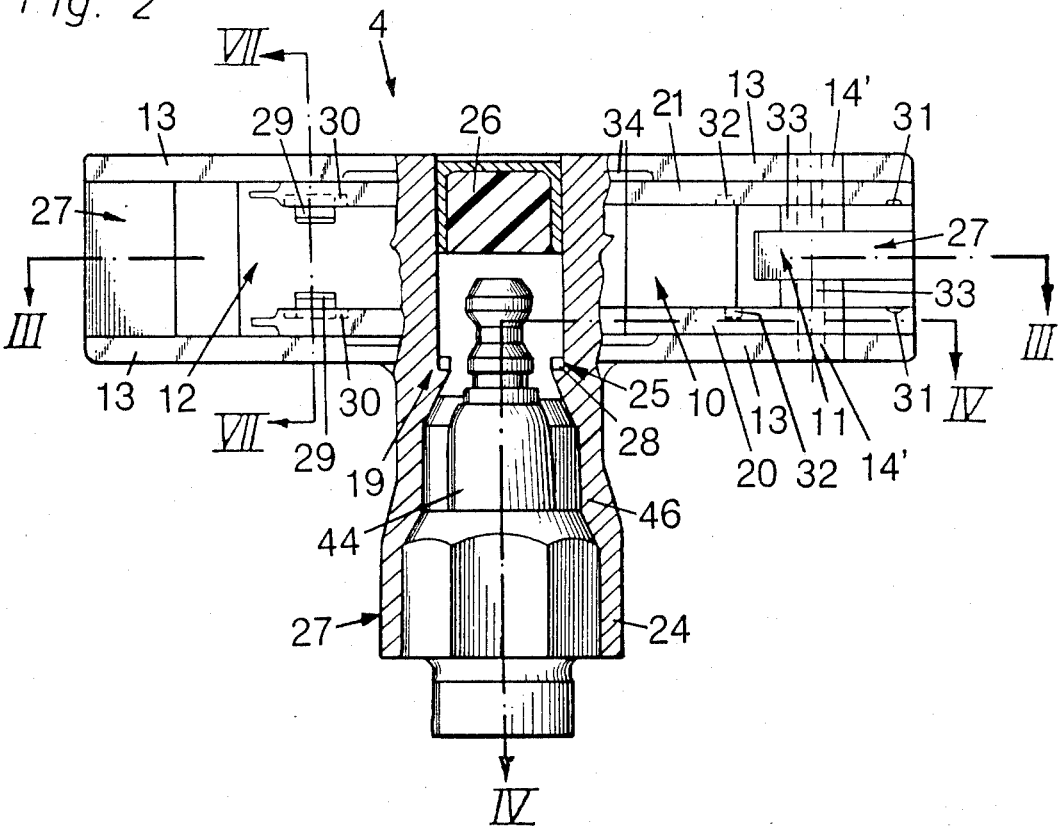
FIG. 2 is a side elevation of a tool-carrier in the form of a starter-handle for a fuel-driven device.
Figure 3:
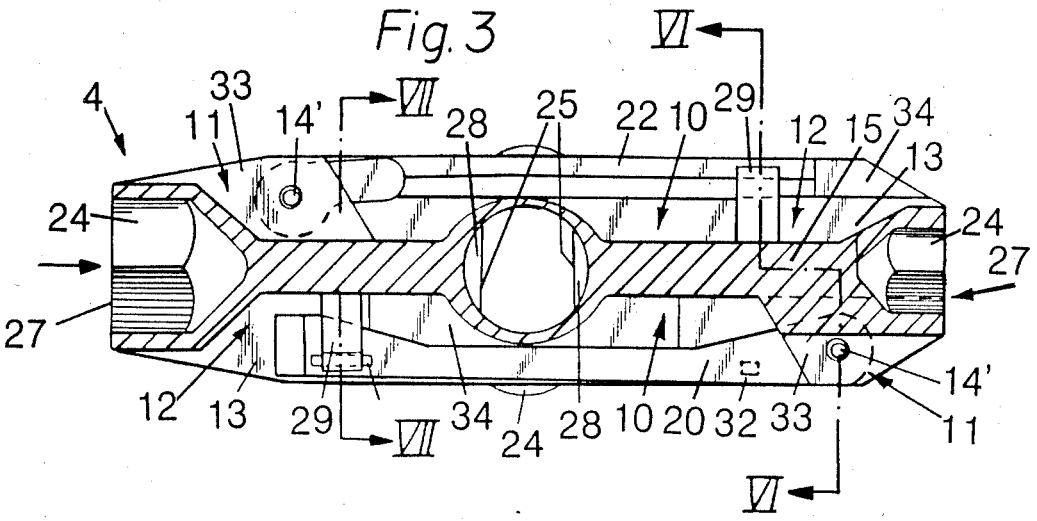
FIGS. 3 and 4 are sections along the lines III—III and IV—IV in FIG. 2, the tools being folded-in in FIG. 3 and folded-out in FIG. 4.
Figure 4:
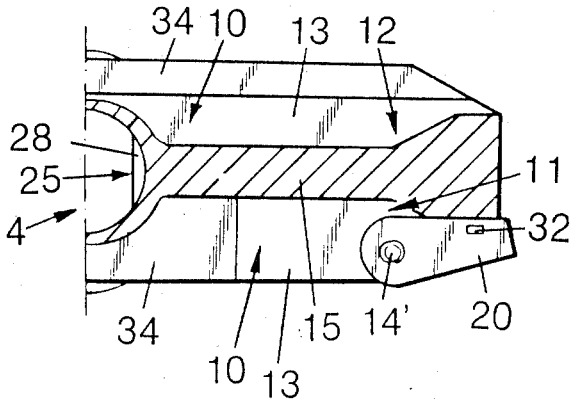
Figure 5:
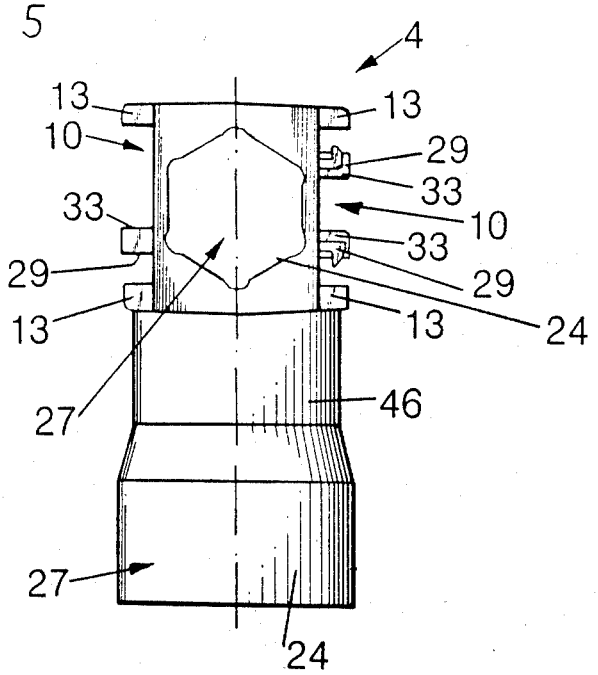
FIG. 5 is a front elevation of the tool-carrier according to FIG. 2, without any tools.
Figure 6:
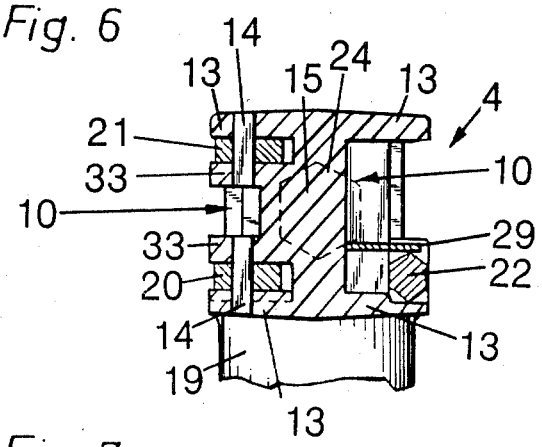
FIGS. 6 and 7 are sections along the lines VI—VI and VII—VII in FIGS. 2 and 3.
Figure 7:
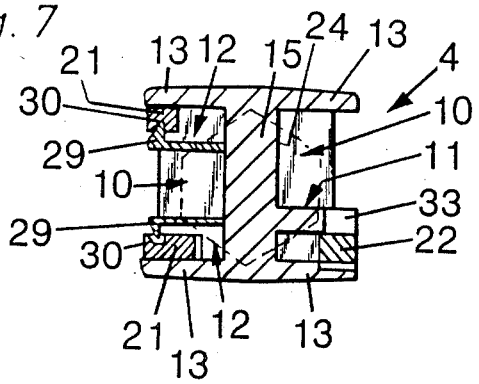
Figure 8:
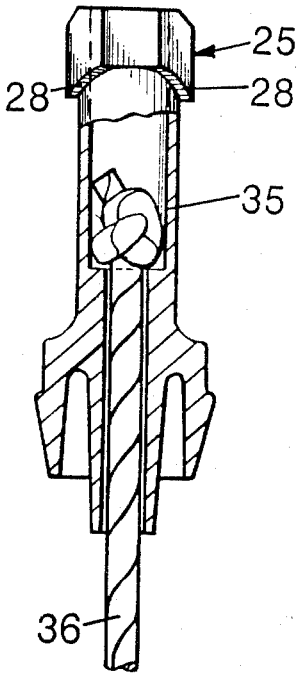
FIG. 8 is a longitudinal section through the part of the functional element of the device associated with the tool-carrier in FIGS. 2–7.

FIG. 1 illustrates a chain-saw 1, by way of example, in general explanation of a device according to the invention. The device comprises functional elements 2,3, element 2 being the starter for the fuel-driven chain-saw engine, and element 3 being carrying or holding grips, for example a carrying handle 6. Functional element 2, i.e. the starter, is actuated by a starter-handle 5 attached to a pull-out starter-cable 36 (FIG. 8). According to the invention, at least one operating part of these functional elements 2,3 is in the form of a tool-carrier 4 which is detachable from the functional element 2,3 and which carries tool which are not removeable under normal conditions. Now if one of these particularly device-specific tools is needed, the tool-carrier 4 is removed. Since removal of the tool-carrier 4 of device 1 eliminates the operating part for functional elements 2,3, the device cannot be set in operation again, or used again, until tool-carrier 4 is replaced. Since any repair or maintenance generally requires at least one functional test, the tool is stowed in such a manner that it is almost impossible for it to be lost.

A description will now be given, in conjunction with FIGS. 2 to 8, of the design of the tool-carrier 4 as a starter grip 5 for a chain-saw which is started by pulling on a cable. Tool-carrier 4 is approximately T-shaped and comprises two holding parts 10 of approximately U-shaped cross-section, united by a common central web 15 and forming the transverse section of the T-shape. The two ends of each holding part 10 are marked 11 and 12, a pivot 14 being arranged, at end 11, in the two lateral webs 13 of holding part 10. At least one tool 20,21,22 is mounted on each pivot 14 in such a manner that it can be swung out. In the embodiment illustrated, pivot 14 is divided into two part-axes 14', the second end of each part-axis 14' engaging in a lug 33 parallel with lateral web 13, the lug being provided only in the vicinity of end 11 of the holding part 10. Provided for each tool, at the end 12 of the holding part, is a resilient locking element 29 which locks the tool in the folded-in position, engaging in a recess 30 of the tool 20,21,22. Depressions 34, on the inside of the lateral web 13, facilitate release of the tools. The tools 20, 21, two different sizes of screwdriver, are locked in the folded-out position by means of a further recess 32 in which a cam 31, which projects from lug 33, engages. Each end of the two holding parts 10 has an end-section 27 in the form of a socket-wrench 24, i.e. another tool.

Central part 46 of the T-shape of tool-carrier 4 forms an attachment section 19 for the detachable connection of tool-carrier 4 to a part 35 of functional element 2. This is shown by way of example in FIG. 8 as the holding piece of starter-cable 36. Attachment-section 19 is fitted with two retaining projections 28 of a bayonet-fastener comprising an arched locking surface. Matching arched retaining projections 28 are provided on the insert section of part 35 of the functional element 2. In order to avoid automatic release of bayonet-fastener 25, it is acted upon by a resilient element 26 which is inserted into central part 46 of the tool-carrier at the edge of the opening for part 35 and is, for example, a foam or micro-cellular rubber part. If a through-passage is provided in central part 46 as an opening for part 35, the end-section, into which the resilient element 26 is inserted, may also form a socket wrench. Free end-section 27 of central part 46 is also in the form of a socket-wrench 24, being designed, in the present example, as a spart-plug wrench for loosening or tightening a spark-plug 44. At least one of the illustrated screwdrivers (tools 20,21) may also serve as a spark-plug gap gauge, the rotational portion being of the same thickness as the usual gap between the electrodes. Tool 22 is a hexagonal socket-head cap-screw which engages a locking element 29 with its outer edges which also have no recesses. In contrast to the screw-drivers, its pivot-angle is limited to about 90° by stopping at the large-socket wrench 24, whereas a 180° stop is provided for the screwdrivers by small socket-wrench 24 at the other end-section 27. Additional tools may be inserted into the free areas of holding parts 10, but these are not shown, mainly for the sake of clarity. In the case of fuel-driven devices in particular, a wire-brush may be added and, for a chain-saw, a file for sharpening the saw teeth etc., since three to four tools can be accommodated quite comfortably in each holding part 10.

As already indicated, the type of power-operated device 1 is not critical since each of its operating parts, which are essential for starting it up and using it, may function as a tool-carrier.

We claim:

1. Tool carrier with at least one service tool as an accessory for a power operated device, said device including means for accomplishing a working function, said working function means comprising:

said tool carrier as attached to said power operated device; and means for detachably attaching said tool carrier to said power operated device for the use of said service tool;

said tool-carrier being formed by a starter-handle fitted to the free end of a starter-cable of a fuel-driven power operated device, for example of a chain-saw, a lawn-mower or the like.

2. Tool carrier according to claim 1, characterized in that the tool-carrier comprises at least one holding part of approximately U-shaped cross-section, at least at one end of the holding part a pivot-axis mounted in the two lateral webs being arranged, at least one tool being mounted to fold inwardly about said pivot-axis.

3. Tool carrier according to claim 2, characterized in that the tool-carrier comprises two holding parts of approximately U-shaped cross-section, the bottoms of said holding parts being formed by a common central web.

4. Tool carrier according to claim 3, characterized in that a double-armed lever is mounted upon the pivot-axis, one arm thereof projecting into the holding part and bearing against each tool and the other arm thereof projecting out of said holding part and serving as a pivot-lever for the inwardly folded tool or tools.

5. Tool carrier according to claim 4, characterized in that a bayonet-fastener is formed between each attachment section of the tool-carrier and an associated part of the functional element of the power-operated device.

6. Tool carrier according to claim 5, characterized in that a resilient element urges said bayonet-fastener into a locking position.

7. Tool carrier according to claim 6, characterized in that at least one end-section of the tool-carrier is in the form of a socket-wrench.

* * * * *